US008350879B2

(12) United States Patent
Larson et al.

(10) Patent No.: US 8,350,879 B2
(45) Date of Patent: Jan. 8, 2013

(54) NON-CONTACT HEATING OF SOLID INK PRINTS AFTER INK FIXING

(75) Inventors: James Rodney Larson, Fairport, NY (US); Jeffrey J. Folkins, Rochester, NY (US); Paul John McConville, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 545 days.

(21) Appl. No.: 12/610,616

(22) Filed: Nov. 2, 2009

(65) Prior Publication Data

US 2011/0102525 A1 May 5, 2011

(51) Int. Cl.
*B41J 2/315* (2006.01)

(52) U.S. Cl. ..... 347/212; 347/171

(58) Field of Classification Search ..... 347/212, 347/171

See application file for complete search history.

(56) References Cited

U.S. PATENT DOCUMENTS 5,791,794 A * 8/1998 Kopp et al. ..... 400/584
5,991,564 A * 11/1999 Ni ..... 399/69
6,759,366 B2 * 7/2004 Beckerdite et al. ..... 503/200
7,245,866 B2 * 7/2007 Frohlich ..... 399/341
7,324,779 B2 * 1/2008 Anderson et al. ..... 399/341
7,576,149 B2 8/2009 Anderson et al.
7,710,442 B2 * 5/2010 Lyons et al. ..... 347/171
2002/0064404 A1 * 5/2002 Iwai ..... 399/309
2006/0291927 A1 * 12/2006 Roof et al. ..... 399/341
2008/0012927 A1 * 1/2008 Kimura et al. ..... 347/179
2008/0248196 A1 10/2008 Anderson et al.
2009/0141110 A1 6/2009 Gervasi et al.

* cited by examiner

*Primary Examiner* — Charlie Peng
(74) *Attorney, Agent, or Firm* — Maginot, Moore & Beck, LLP

(57) ABSTRACT

An imaging device includes a media transport system configured to transport print media along a media path. A first print station is positioned along the media path that is configured to apply ink to a first side of the media. A first fixing assembly is positioned along the media path downstream from the first print station. A second print station is positioned along the media path downstream from the first fixing assembly that is configured to apply ink to a second side of the media. A second fixing assembly is positioned along the media path downstream from the second print station. A heater is positioned along the media path downstream from the second fixing assembly that is configured to heat the media to a gloss reducing temperature.

13 Claims, 2 Drawing Sheets

NON-CONTACT HEATING OF SOLID INK PRINTS AFTER INK FIXING

TECHNICAL FIELD

The present disclosure relates to ink-jet printing and, in particular to ink-jet printing onto a substantially continuous web of media.

BACKGROUND

In general, ink jet printing machines or printers include at least one printhead that ejects drops or jets of liquid ink onto a recording or image forming media. A phase change ink jet printer employs phase change inks that are in the solid phase at ambient temperature, but transition to a liquid phase at an elevated temperature. The molten ink can then be ejected onto a printing media by a printhead directly onto an image receiving substrate, or indirectly onto an intermediate imaging member before the image is transferred to an image receiving substrate. Once the ejected ink is on the image receiving substrate, the ink droplets quickly solidify to form an image.

In both the direct and offset printing architecture, images may be formed on a media sheet or a media web. In a web printer, a continuous supply of media, typically provided in a media roll, is mounted onto rollers that are driven by motors. A loose end of the media web is passed through a print zone opposite the print head or heads of the printer. Beyond the print zone, the media is gripped and pulled by mechanical structures so a portion of the media continuously moves through the print zone. Tension bars or rollers may be placed in the feed path of the moving web to remove slack from the web so it remains taut without breaking.

In continuous-web direct to paper printing, a fixing assembly is typically used after the ink is jetted onto the web to fix the ink to the web. The fixing assembly used depends on the type of ink. For example, when using melted phase change ink to form images, the fixing assembly may include a spreader configured to apply pressure to the ink and media to spread the ink on the media. The function of the spreader is to transform a pattern of ink droplets deposited onto a media and spread them out to make a more uniform and continuous layer. The spreader uses pressure and/or heat to reduce the height of the ink droplets and fill the spaces between adjacent drops. In another example, when using an aqueous ink to form images, the fixing assembly may include a contact or non-contact heater used to reduce the water or other volatiles from the paper and ink and thereby, among other things, reduce any potential smear or damage from subsequent contact of the inked media surfaces.

Some direct marking, continuous web printers are configured to print images onto both sides of the web, also referred to as duplex printing. To enable duplex printing on a continuous web, a web transport system may be configured to guide a web through a first print station to print on the first side of the web, also referred to as the simplex side, then invert the web and either guide the web back through the first print station or guide the web through a print zone of a second print station for printing on the second side of the web, also referred to as the duplex side.

One difficulty associated with duplex printing in such systems is that when the media is passing through the print station for printing on the duplex side, the simplex side of the media is pressed against several surfaces and rollers, and may be exposed to different temperatures and pressures, such as the heat and/or pressure applied by the spreader. Such contact between the simplex side of the media and the surfaces of the printer as well as the temperatures and pressures associated with such surfaces may adversely impact the image quality of images formed on the simplex side of the media. One particular image quality defect that may result when printing on the duplex side of the media is a reduction of the glossiness of the images on the simplex side creating a simplex side versus duplex side gloss differential.

SUMMARY

In order to reduce the gloss differential that may occur between the simplex side and the duplex side during duplex printing onto a continuous media, an imaging device has been developed that includes a non-contact radiant heater positioned to direct radiant heat onto the duplex side of the media after the ink on the duplex side of the media has been spread. The non-contact radiant heating of the duplex side of the media reduces the gloss of the image on the duplex side in order to reduce gloss differential problems because the final gloss of the images on the media strongly depends on ink and media properties and weakly depends on the initial gloss.

In one particular embodiment, an imaging device includes a substantially continuous media of media, and a media transport system configured to transport the continuous media along a media path. A first side print station is positioned along the media path and is configured to apply ink to a first side of the continuous media to form images thereon. A second side print station is positioned along the media path downstream from the first side print station and is configured to apply ink to a second side of the continuous media to form images thereon after the first side print station applies the ink to the first side of the media. A radiant heating system disposed along the media path downstream from the second side print station. The radiant heater system is configured to direct radiant heat onto the second side of the media at a gloss reducing temperature.

In another embodiment, a method of operating an imaging device includes transporting a substantially continuous media of media along a media path. Ink is deposited onto a first side of the continuous media at a first print station positioned along the media path. Pressure is then applied to the continuous media and the ink deposited onto the first side using a first spreader. Ink is then deposited onto the second side of the media at a second print station positioned along the media path after the first spreader. Pressure is then applied to the continuous media and the ink deposited onto the second side using a second spreader. After the application of pressure by the second spreader, the continuous media is heated to a gloss reducing temperature using a radiant heating system.

In yet another embodiment, an imaging device includes a substantially continuous media of media, and a media transport system configured to transport the continuous media along a media path. A first side print station is positioned along the media path and configured to apply liquid phase change ink to a first side of the continuous media to form images thereon. A first spreader is positioned along the media path after the first side print station that is configured to apply pressure to the continuous media. A second side print station is positioned along the media path downstream from the first spreader and is configured to apply liquid phase change ink to a second side of the continuous media to form images thereon. A second spreader positioned along the media path after the second side print station that is configured to apply pressure to the continuous media. A radiant heating system is disposed along the media path downstream from the second spreader. The radiant heater system is configured to direct radiant heat onto the second side of the media to heat the second side of the media to a gloss reducing temperature.

DETAILED DESCRIPTION

Figure 1:
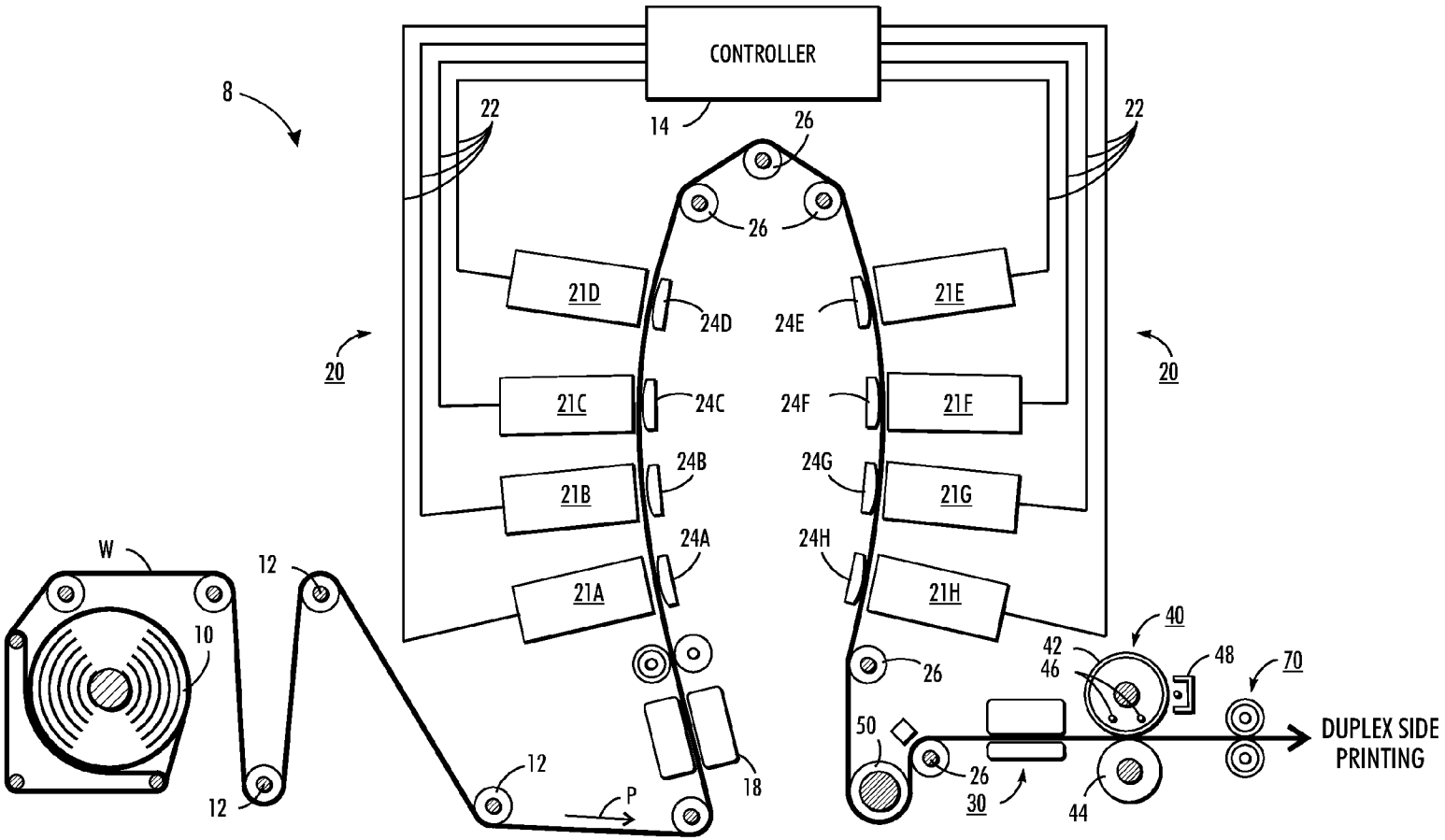
FIG. 1 is a simplified elevational view of a direct-to-media, continuous-web, phase-change ink printer.

For a general understanding of the present embodiments, reference is made to the drawings. In the drawings, like reference numerals have been used throughout to designate like elements.

As used herein, the term "imaging device" generally refers to a device for applying an image to print media. "Print media" may be a physical sheet of paper, plastic, or other suitable physical print media substrate for images, whether precut or continuous media fed. The imaging device may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like. As used herein, the process direction is the direction in which an image receiving surface, e.g., media sheet or media, or intermediate transfer drum or belt, onto which the image is transferred moves through the imaging device. The cross-process direction, along the same plane as the image receiving surface, is substantially perpendicular to the process direction.

FIG. 1 is a simplified elevational view of a direct-marking, continuous feed, phase-change ink printer 8. A media supply and handling system is configured to supply a very long (i.e., substantially continuous) media of media W of "substrate" (paper, plastic, or other printable material) from a media source, such as spool 10. The media W may be unwound as needed, and propelled by a variety of motors, not shown. The media supply and handling system is capable of transporting the media at a plurality of different speeds. A set of rolls 12 controls the tension of the unwinding media as the media moves through a path. In alternative embodiments, the media may be transported along the path in cut sheet form in which case the media supply and handling system may include any suitable device or structure that enable the transport of cut media sheets along a desired path through the imaging device.

Along the path there is provided at least one preheater 18, which brings the media to an initial predetermined temperature. The preheater 18 can rely on contact, radiant, conductive, or convective heat to bring the media W to a target preheat temperature, which in one practical embodiment, is in a range of about 30° C. to about 70° C.

The media web W is transported through a printing station 20 including a series of printheads 21A-21H, each printhead effectively extending across the width of the media and being able to place ink of one primary color directly (i.e., without use of an intermediate or offset member) onto the moving media. Eight printheads are shown in FIG. 1 although more or fewer printheads may be used. As is generally familiar, each of the four primary-color images placed on overlapping areas on the media web W combine to form color images, based on the image data sent to each printhead through image path 22 from print controller 14. In various possible embodiments, there may be provided multiple printheads for each primary color; the printheads can each be formed into a single linear array. The function of each color printhead can be divided among multiple distinct printheads located at different locations along the process direction; or the printheads or portions thereof can be mounted movably in a direction transverse to the process direction P, such as for spot-color applications.

In one embodiment, the marking media applied to the media is a "phase-change ink," by which is meant that the ink is substantially solid or gelatinous at room temperature and substantially liquid when heated and initially jetted onto the media. In one embodiment, phase-change inks are heated to about 80° C. to 140° C., and thus in liquid phase, upon being jetted onto the media W. Generally speaking, the liquid ink cools down quickly upon hitting the media W. In alternative embodiments, however, any suitable marking material or ink may be used including, for example, ultraviolet (UV) curable ink, toner or aqueous ink.

Each printhead may have a backing member 24A-24H, typically in the form of a bar or roll, which is arranged substantially opposite the printhead on the other side of W. Each backing member is used to position the media so that the gap between the printhead and the sheet stays at a known, constant distance. Each backing member can be controlled to cause the adjacent portion of the media to reach a predetermined "ink-receiving" temperature, in one practical embodiment, of about 40° C. to about 70° C. In various possible embodiments, each backing member can include heating elements, cavities for the flow of liquids therethrough, etc.; alternatively, the "member" can be in the form of a flow of air or other gas against or near a portion of the media W. The combined actions of preheater 18 plus backing members 24 held to a particular target temperature effectively maintains the media in the printing zone 20 in a predetermined temperature range of about 40° C. to 70° C.

As the partially-imaged media moves to receive inks of various colors throughout the printing station 20, the temperature of the media is maintained within a given range. Ink is jetted at a temperature typically significantly higher than the receiving media's temperature which heats the surrounding paper (or whatever substance the media is made of). Therefore the members in contact with or near the media in zone 20 must be adjusted so that that the desired media temperature is maintained. For example, although the backing members may have an effect on the media temperature, the air temperature and air flow rate behind and in front of the media may also impact the media temperature. Accordingly, air blowers or fans may be utilized to facilitate control of the media temperature.

The media temperature is kept substantially uniform for the jetting of all inks from printheads in the printing zone 20. This uniformity is valuable for maintaining image quality, and particularly valuable for maintaining constant ink lateral spread (i.e., across the width of media W, such as perpendicular to process direction P) and constant ink penetration of the media. Depending on the thermal properties of the particular inks and the media, this media temperature uniformity may be achieved by preheating the media and using uncontrolled backer members, and/or by controlling the different backer members 24A-24H to different temperatures to keep the substrate temperature substantially constant throughout the printing station. Temperature sensors (not shown) associated with the media may be used with a control system to achieve this purpose, as well as systems for measuring or inferring (from the image data, for example) how much ink of a given primary color from a printhead is being applied to the media at a given time. The various backer members can be controlled individually, using input data from the printhead adjacent thereto, as well as from other printheads in the printing station.

Following the midheaters 30, along the path of the media, is a fixing assembly 40 that is configured to apply heat and/or pressure to the media to fix the images to the media. The fixing assembly may include any suitable device or apparatus for fixing images to the media including heated or unheated pressure rollers, radiant heaters, heat lamps, and the like. In the embodiment of the FIG. 1, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure, and, in one embodiment, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes rolls, such as image-side roll 42 and pressure roll 44, that apply heat and pressure to the media. Either roll can include heat elements such as 46 to bring the web W to a temperature in a range from about 35° C. to about 80° C.

In one practical embodiment, the roll temperature in spreader 40 is maintained at a temperature to an optimum temperature that depends on the properties of the ink such as 55° C.; generally, a lower roll temperature gives less line spread while a higher temperature causes imperfections in the gloss. Roll temperatures that are too high may cause ink to offset to the roll. In one practical embodiment, the nip pressure is set in a range of about 500 to about 2000 psi lbs/side. Lower nip pressure gives less line spread while higher may reduce pressure roll life.

The spreader 40 may also include a cleaning/oiling station 48 associated with image-side roll 42, suitable for cleaning and/or applying a layer of some lubricant, release oil, or other material to the roll surface. Such a station coats the surface of the spreader roll with a lubricant such as amino silicone oil having viscosity of about 10-200 centipoises. Only small amounts of oil are required and the oil carry out by media W is only about 1-10 mg per A4 size page.

To further control the temperature of the media and/or the ink on the media, a temperature leveling roller and one or more midheaters may be positioned along the media path following the printing zone prior to entering the spreader. For example, as shown in FIG. 1, a leveler roller 50 may be placed along the media path between the printing zone and the spreader 40. In one embodiment, the leveler roller 50 is configured as an idler roller that derives its rotational motion from frictional engagement of the roller surface with the moving media. However, the leveler roller may be a driven in accordance with the media speed by a drive mechanism (not shown), such as a drive motor operably coupled to the roller. Suitable coupling may be through a drive belt, pulley, output shaft, gear or other conventional linkage or coupling mechanism. Tension rollers 26 may also be provided to control the carrying in angle and/or carrying out angle of the media relative to the leveler roller 50.

The leveler roller 50 is a temperature controlled, thermally conductive roller designed to operate at a temperature lower than the incoming ink and media temperatures. In one embodiment, the leveler roller is configured to operate at a target temperature of about 30° C. to about 45° C. Any suitable leveler roller operating temperature, however, may be used. The leveler roller may be formed of a thermally conductive material, such as aluminum, although the core may be made of other suitable materials, such as iron, nickel, stainless steel, and various synthetic resins. The development of thermal energy in the leveler roller 50 may be accomplished in any suitable manner. For example, the leveling roller may include a hollow core and include one or more heating elements (not shown) disposed therein for generating the required thermal energy in the roller.

Midheaters may be positioned along the media path downstream from the leveler roller, i.e., after the leveler roller in the process direction of the media. Midheaters 30 can use contact, radiant, conductive, and/or convective heat to bring the media W to the target temperature. The midheaters 30 bring the ink placed on the media to a temperature suitable for desired properties when the ink on the media is sent through the spreader 40. In one embodiment, a useful range for a target temperature for the midheater is about 35° C. to about 80° C. The midheaters 30 have the effect of equalizing the ink and substrate temperatures to within about 15° C. of each other. Lower ink temperature gives less line spread while higher ink temperature causes show-through (visibility of the image from the other side of the print). The midheaters 30 adjust substrate and ink temperatures to −10° C. to 20° C. above the temperature of the spreader.

Operation and control of the various subsystems, components and functions of the device 8 are performed with the aid of a controller 14. The controller 14 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the difference minimization function, described above. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

In duplex printing, following the deposition of ink on the simplex side of the media to form images and the spreading of the ink on the simplex side during passage through the spreader 40, the media may be imaged on the duplex side of the media. For example, in one embodiment, the media may be inverted and side shifted and directed back to the entrance area of the media path and passed through the print zone next to the initial media but with the duplex side of the media facing the printheads. Alternatively, the media may be guided through the print zone of another imaging device for printing on the duplex side of the media. In either case, the ink on the duplex side of the media is eventually spread during passage through a spreader to promote image uniformity and adherence to the duplex side of the media.

As mentioned above, moving the media through an imaging device to form images on the duplex side of the media, and particularly through the spreader a second time to spread the ink on the duplex side of the media, may impact the image quality of the images formed on the simplex side of the media, and, in some cases, may result in a reduction of the glossiness or gloss level of the images on the simplex side. As used herein, the terms "gloss" or "glossiness" generally refers to the capacity of a surface to reflect more light in the specular direction as compared to other directions. Gloss level is a measurement of the degree of specular reflectance of a surface. Gloss levels are referred to with reference to gloss units as measured by a conventional gloss meter, such as a Gardner gloss meter, that measures the gloss level at a specific angle of incidence with respect to the surface, e.g., 20 degree, 30 degree, 45 degree, 60 degree, 75 degree and 80 degree, etc. In an effort to limit the gloss reduction of simplex side images during duplex side printing, some previously known systems were forced to limit the temperature and/or pressure set points of print process components, especially the spreader, in order to prevent damage to the simplex side images as it contacts these components which in turn limits ink spread and image robustness.

Tests have found that if a side of a piece of media such as paper is heated with a non-contact radiant heater after spreading, the gloss level of the images on the side can be reduced without disturbing the image quality. Simple tests gave up to a 10 gloss unit reduction in both single and two layer ink solids without any measurable decrease in color saturation (e.g. <1 deltaE) or increase in show-through. In addition to the gloss reduction of the prints, the post spreading radiant heat step may have the added benefit of driving the release oil used in the spreader into the ink thereby reducing contamination of finishing components due to excessive oil.

Accordingly, as an alternative to limiting or restricting temperature and/or pressure set points of print process components to prevent the reduction in the gloss level of the simplex side images, the present disclosure proposes the use of a non-contact, radiant heating system positioned to radiantly heat the ink images on the duplex side of the media after passage through the second spreader, or duplex side spreader to reduce the gloss level of the duplex side of the media to approximate the gloss level of the simplex side of the media.

Figure 2:
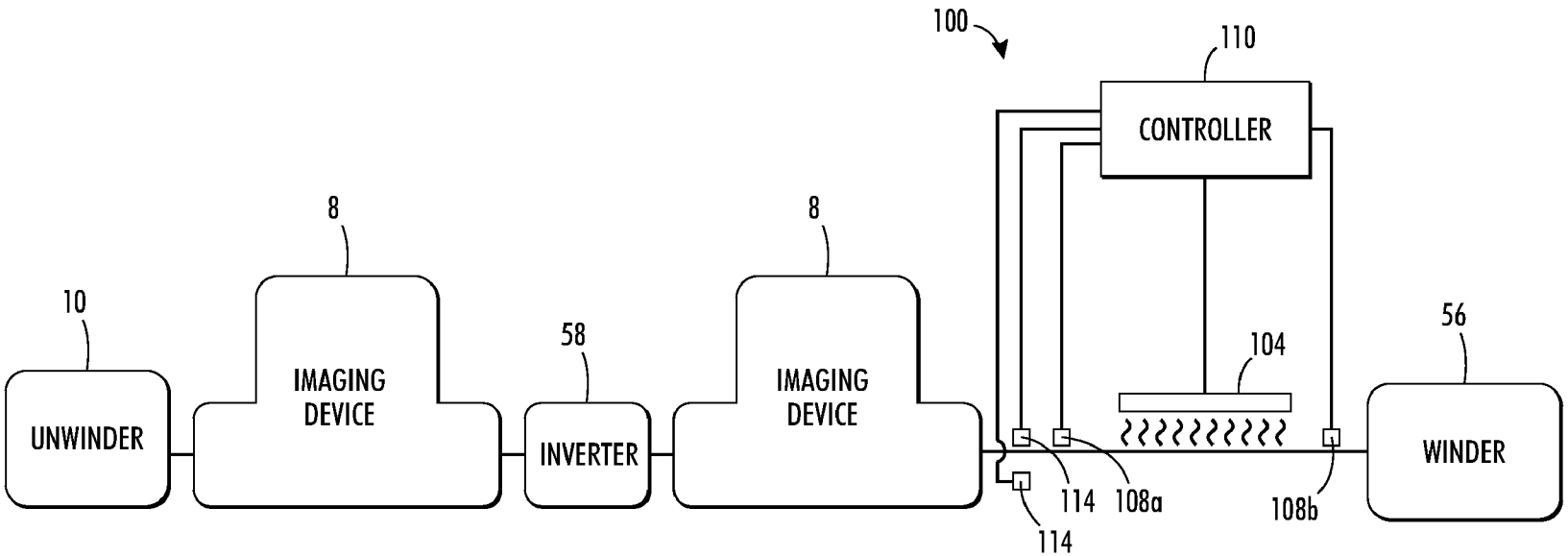
FIG. 2 is a schematic view of an embodiment of post-spreader gloss reducing system for use with the imaging device of FIG. 1.

Referring now to FIG. 2, a schematic diagram of an embodiment of a duplex printing system that utilizes at least one imaging device such as depicted in FIG. 1 and that includes a post-spreader media heating system is shown. As depicted, the media is supplied to a first imaging device 8 for printing on a first side of the media, e.g., the simplex or first media side. Although not depicted in FIG. 2, the first imaging device includes a spreader such as spreader 40 of FIG. 1 for spreading the ink deposited onto the simplex side of the media. After the simplex side spreading, the media W is inverted at a media inverter 58 and guided to a second imaging device for printing on the second side, or duplex side of the media. Similar to the first imaging device, the second imaging device includes a spreader, e.g., spreader 40 of FIG. 1, for spreading the ink deposited on the duplex side of the media. Although two separate imaging devices 8 are schematically shown in FIG. 2 for printing on the simplex and duplex sides of the media, the media transport system may be configured to transport two strands of the media through a print zone simultaneously past a single print station and spreader. A first strand may be received from a source for the continuous media with a first side or simplex side facing toward the print station, and a second strand may be received from the inversion system with the second side or duplex side facing toward the print station.

As depicted in FIG. 2, the heating system includes at least one radiant heating unit 104 positioned to emit thermal radiation onto the duplex side of the media 20 after passage through the duplex side spreader. In the embodiment of FIG. 2, a single radiant heating unit is shown although any suitable number of heating units may be utilized. The media is heated by absorbing the thermal radiation from the unit 104 emitted at a predetermined gloss reducing temperature that is configured to reduce the gloss level of the images formed on the duplex side of the media to a gloss level that approximates the gloss level of the images on the simplex side of the media. The gloss reducing temperature may be any suitable temperature that is capable of providing the desired reduction in the gloss level of the duplex side images and may be dependant upon a number of factors including media speed, media type, ink type, position along the media pathway, etc. In one embodiment, the radiant heating unit 104 is configured to heat the duplex side of the media to approximately 65° C. to approximately 70° C. In some embodiments, heat may also be applied to the simplex side of the sheet. Such a configuration may be useful, for example, if the gloss level on the duplex side goes to a saturated level.

The development of thermal energy in the heating unit 104 may be accomplished in any suitable manner. For example, heat may be generated in a heating unit by a resistance heating element (now shown). Alternatively, a heating unit may include one or more heating lamps such as quartz, carbon filament or halogen lamps mounted between a ceramic backing and a protective quartz plate (front side). In any case, the heating unit 104 is configured to emit thermal radiation in accordance with an electrical current provided by one or more heater power supplies (not shown). As described below, the media heating controller 110 is operable to control the amount of electrical current supplied to the heating unit via the power supply.

The media heating controller may be implemented as hardware, software, firmware or any combination thereof. In addition, the media heating controller may be a standalone controller or may be incorporated into the system controller. The media heating controller 110 may be configured to control the thermal radiation emitted by the radiant heating unit(s) 104 based, at least in part, on the measured temperature of the media media. To that end, the media heating system may include one or more temperature sensors 108 as are known in the art for measuring the temperature of the moving media 20 at one or more locations prior to, during, and after heating by the radiant heaters. Temperature sensors 108 may comprise non-contact type sensors such as thermopile or similar IR sensor. In one embodiment, a temperature sensor 108A is provided along the media pathway just upstream from the radiant heating unit 104 of the media heating system to detect the temperature of the media downstream from the spreader and prior to passing by the radiant heating units. Another temperature sensor 108B may also be provided along the media pathway downstream from the radiant heating units 104 to detect the temperature of the media after being heated by the heating units. In any case, the temperature sensors 108 are operable to relay signals indicative of the one or more measured temperatures to the heating controller 110. The controller is operable to control power to the heating units based on the signals received from the temperature sensors in order to heat the media to the desired gloss reducing temperature.

The media heating controller 110 may also be configured to control power to the radiant heating units as a function of the gloss level of the images on the simplex side and/or the duplex side of the media. For example, the greater the gloss level of the simplex side of the media, the less the gloss level of the duplex side of the media has to be reduced in order to achieve similar gloss levels on both the simplex and duplex sides, and vice versa. The gloss level of images on the simplex and duplex side of the media may be measured using one or more glossmeters 114 positioned adjacent the media path downstream from the spreader and prior to passing by the radiant heating unit(s). The glossmeters are configured to output signals indicative of the gloss level on the simplex side and the duplex side of the media to the heating controller 110. The controller may be operable to control power to the heating units based on the signals received from the gloss meters in order to heat the duplex side of the media to the desired gloss reducing temperature. For example, the controller may be configured to control the thermal output of the heating units as a function of the gloss level of the simplex side of the media, as a function of the gloss level of the duplex side of the media, and/or as a function of the difference between the gloss levels of the simplex and duplex sides of the media.

In addition to the reduction of gloss differential between simplex side and duplex side images, the non-contact post heater may be used in a fixing mode to increase robustness and permanence of images in applications in which image quality factors, such as image color saturation and the presence of show-through, are not critical. In the fixing mode, the post spreading radiant heaters are configured to heat the media to a higher temperature than the gloss reducing temperature in order to cause the ink to soak appreciably into the media. In the fixing mode, the images may gain a significant improvement in robustness and permanence but with a sacrifice in image color saturation and the presence of show-through. Such a configuration may even be used with coated stock papers to achieve improved image permanence. In this mode the heater may be configured either as a single sided or as a two sided heater. Additionally one could place two heaters, one each after each media in order to achieve image robustness on both sides of the media.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. An imaging device comprising:

a media transport system configured to transport media along a media path, the media having a first side and a second side;

a first print station positioned along the media path and configured to apply ink to the first side of the media to form images thereon;

a first fixing assembly positioned along the media after the first print station;

a second print station positioned along the media path and configured to apply ink to a second side of the media to form images thereon after the first fixing assembly applies pressure to the media;

a second fixing assembly positioned along the media path after the second print station;

a non-contact heater positioned along the media path downstream from the second fixing assembly, the heater being positioned to heat the second side of the media only;

a first glossmeter positioned to measure a gloss level of the images on the first side of the media only;

a second glossmeter positioned to measure a gloss level of the images on the second side of the media only; and a controller operatively connected to the first glossmeter and the second glossmeter, the controller being configured to control electrical power to only the non-contact heater that heats the second side of the media only with reference to the signals received from the first glossmeter and the second glossmeter to enable the non-contact heater to heat only the second side of the media to a temperature that reduces a difference between the gloss level measured for the images on the second side of the media and the gloss level measured for the images on the first side of the media.

2. The imaging device of claim 1, further comprising:

an inversion system positioned along the media path between the first fixing assembly and the second print station and configured to invert the media for printing on the second side by the second print station.

3. The imaging device of claim 1, the ink applied to the first and the second side of the media comprising melted phase change ink.

4. The imaging device of claim 3, the gloss reducing temperature being between approximately 45° C. and approximately 80° C.

5. The imaging device of claim 4, the gloss reducing temperature being between approximately 50° C. and approximately 60° C.

6. The imaging device of claim 4, the non-contact heater comprising at least one radiant heater positioned to emit thermal radiation onto the second side of the media only.

7. A method of operating an imaging device comprising:

transporting print media along a media path;

depositing ink onto a first side of the media at a first print station positioned along the media path;

applying heat and/or pressure to the media after the ink is deposited onto the first side using a first fixing assembly;

depositing ink onto the second side of the media at a second print station positioned along the media path after the first fixing assembly applies heat and/or pressure to the media;

applying heat and/or pressure to the media using a second fixing assembly after the ink is deposited onto the second side;

measuring a gloss level for the ink deposited on the first side of the media;

measuring a gloss level for the ink deposited on the second side of the media; and controlling electrical power to a non-contact heater that heats only the second side of the media with reference to the measured gloss levels for the first side of the media and the second side of the media to heat the second side of the media only to a temperature after the application of pressure by the second fixing assembly, the temperature being in a range that reduces a difference between the measured gloss level of the images on the second side of the media and the gloss level of the images on the first side of the media.

8. The method of claim 7, the ink applied to the first and the second side of the media comprising melted phase change ink.

9. The method of claim 8, the gloss reducing temperature being between approximately 45° C. and approximately 80° C.

10. The method of claim 7, the heating of only the second side of the media with the non-contact heater further comprising:

radiantly heating the second side of the media to the gloss reducing temperature using at least one radiant heater positioned to direct radiant heat onto the second side of the media only.

11. The method of claim 7, further comprising:

inverting the media after the application of heat and/or pressure to the first side of the media and the ink thereon prior to depositing ink onto the second side of the media at the second print station.

12. An imaging device comprising:

a source of media;

a media transport system configured to transport the media from the source along a media path;

a first side print station positioned along the media path and configured to apply melted phase change ink to a first side of the media to form images thereon;

a first fixing assembly positioned along the media path after the first side print station;

a second side print station positioned along the media path downstream from the first fixing assembly and configured to apply melted phase change ink to a second side of the media to form images thereon;

a second fixing assembly positioned along the media path after the second side print station;

at least one radiant heater disposed along the media path downstream from the second spreader, the at least one radiant heater being configured to direct radiant heat onto the second side of the media only;

a first glossmeter positioned to measure a gloss level of the images on the first side of the media;

a second glossmeter positioned to measure a gloss level of the images on the second side of the media; and a controller operatively connected to the first glossmeter and the second glossmeter, the controller being configured to control electrical power to the at least one radiant heater that directs radiant heat onto the second side of the media only with reference to the signals received from the first glossmeter and the second glossmeter to enable the at least one radiant heater to heat only the second side of the media to a temperature that reduces a difference between the gloss level measured for the images on the second side of the media and the gloss level measured for the images on the first side of the media.

13. The imaging device of claim 3, the gloss reducing temperature being between approximately 45° C. and approximately 80° C.

* * * * *